United States Patent [19]

Nishida

[11] Patent Number: 4,768,491

[45] Date of Patent: Sep. 6, 1988

[54] FUEL SUPPLY CONTROL SYSTEM FOR AN INTERNAL COMBUSTION ENGINE

[75] Inventor: Minoru Nishida, Amagasaki, Japan

[73] Assignee: Mitsubishi Denki Kabushiki Kaisha, Japan

[21] Appl. No.: 3,762

[22] Filed: Jan. 16, 1987

[30] Foreign Application Priority Data

Jan. 17, 1986 [JP] Japan ..... 61-6200

[51] Int. Cl.[4] ..... F02D 41/34

[52] U.S. Cl. ..... 123/494; 123/486; 123/488

[58] Field of Search ..... 123/494, 486, 480, 488

[56] References Cited

U.S. PATENT DOCUMENTS

| | | | |
|---|---|---|---|
| 3,725,678 | 4/1973 | Reddy | 307/264 |
| 4,005,689 | 2/1977 | Barnard | 123/494 |
| 4,108,122 | 8/1978 | Barnard | 123/438 |
| 4,442,812 | 4/1984 | Mizuno et al. | 123/480 |
| 4,594,987 | 6/1986 | Wataya et al. | 123/494 |
| 4,683,539 | 7/1987 | Kanno et al. | 123/494 |
| 4,694,806 | 9/1987 | Wataya et al. | 123/494 |
| 4,706,634 | 11/1987 | Nishikawa et al. | 123/492 |

*Primary Examiner*—Andrew M. Dolinar

*Attorney, Agent, or Firm*—Leydig, Voit & Mayer

[57] ABSTRACT

A fuel supply control system for an internal combustion engine which is capable of precisely controlling the amount of fuel to be supplied to an engine so as to provide a predetermined air/fuel ratio irrespective of the provision of an EGR system or the amount of EGR in the case of EGR control. Fuel is supplied to an engine by fuel injection valves, and a part of exhaust gas discharged from the engine is adjustably recirculated to a location downstream of a throttle valve in an intake pipe. In a memory that is stored data detemining the amounts of fuel to be supplied to the engine in the absence of the exhaust gas recirculation corresponding to the respective engine operating conditions which are determined by the manifold pressure of the intake gases at the downstream side of the throttle valve detected by a pressure detector and the engine RPM detected by an engine RPM detector, and which are classified in a two dimensional manner. The data, read out from the memory corresponding to the detected engine RPM and the detected pressure of the intake gases, is corrected in accordance with the oxygen density in the intake gases detected by an oxygen density detector so that the fuel injection time for the fuel injection valves can be calculated on the basis of the data thus corrected.

3 Claims, 2 Drawing Sheets

FUEL SUPPLY CONTROL SYSTEM FOR AN INTERNAL COMBUSTION ENGINE

BACKGROUND OF THE INVENTION

1. Field of the Invention

The present invention relates to a fuel supply control system for an internal combustion engine, and more particularly, to such a fuel supply control system which is adapted to electrically control the amount of fuel to be supplied to an engine in an electrical way on the basis of data which is previously stored in a memory for determining the optimal amounts of fuel for respective engine operating conditions determined by manifold pressure and RPM of the engine, and which is read out in response to the ever-changing engine operating conditions.

2. Description of the Prior Art

Various kinds of fuel supply control systems for internal combustion engines have hitherto been proposed which control, by detecting the amount of intake air sucked into an engine as desired from manifold pressure and RPM of the engine, the amount of fuel to be supplied to the engine by means of a fuel injection valve, which is operated to open and close in synchronization with RPMs so as to maintain the air/fuel ratio at a predetermined value.

In recent years, many internal combustion engines have an exhaust gas recirculation system (hereinafter referred to as EGR) in order to cope with automotive emission controls imposed by governments of various countries. In such cases, with the above-described conventional fuel supply control systems in which the amount of intake air is detected from the manifold pressure and RPM's, it is impossible to precisely control the amount of fuel being supplied to an engine in such a manner as to provide a predetermined air/fuel ratio. That is, in cases where EGR control is effected, the pressure detected as manifold pressure also includes the pressure of the EGR gas which does not contribute to the combustion of fuel, thereby making it impossible to detect the actual amount of intake air in a precise manner. As a result, it is difficult to precisely control the amount of fuel to be supplied to the engine to provide a predetermined air/fuel ratio.

SUMMARY OF THE INVENTION

In view of the above, the present invention is intended to obviate the above-described problems of the prior art, and has for its object the provision of a novel and improved fuel supply control system for an internal combustion engine which is capable of precisely controlling the amount of fuel to be supplied to an engine so as to provide a predetermined air/fuel ratio irrespective of the provision of an EGR system or the amount of EGR in the case of EGR control.

In order to achieve the above object, according to the present invention, there is provided, in an internal combustion engine which is adapted to be supplied with fuel by a fuel injection apparatus and in which a part of the exhaust gas discharged from the engine proper is adjustably recirculated to a location downstream of a throttle valve in an intake pipe, a fuel supply control system comprising:

an engine rpm detector for detecting the number of revolutions per minute (RPM) of the engine;

a pressure detector for detecting manifold pressure of the intake gases in the portion of the intake pipe downstream of the throttle valve;

an oxygen density detector for detecting the density of the oxygen in the intake gases in the intake pipe after a part of the engine exhaust gas has been recirculated to the intake pipe downstream of the throttle valve;

a memory for prestoring data determining the amount of fuel to be supplied to the engine in the absence of the exhaust gas recirculation and corresponding to respective engine operating conditions which are determined by the manifold pressure of the intake gases downstream of the throttle valve detected by the pressure detector and the engine RPM detected by the engine RPM detector, the data being classified in a two dimensional manner;

a corrector for correcting the data, which is read out from the memory corresponding to the engine RPM detected by the engine RPM detector and the manifold pressure of the intake gases detected by the pressure detector, by multiplying the data by the ratio of the oxygen density in the intake gases detected by the oxygen density detector to the oxygen density in the atmosphere; and a calculator for calculating a fuel injection time for the fuel injection apparatus on the basis of the data corrected by the corrector.

It is preferable that the calculator for calculating fuel injection time send out to the fuel injection apparatus a time pulse corresponding to the data corrected by the corrector in synchronization with the engine RPM detected by the RPM detector.

It is also preferable that the oxygen density detector detect the oxygen density in the intake gases corresponding to the temperature of the intake gases.

The above and other objects, features and advantages of the present invention will become apparent from the following detailed description of a presently preferred embodiment of the invention when taken in conjunction with the accompanying drawings.

DESCRIPTION OF THE PREFERRED EMBODIMENT

The present invention will now be described in detail with reference to a presently preferred embodiment thereof as illustrated in the accompanying drawings.

Figure 1:
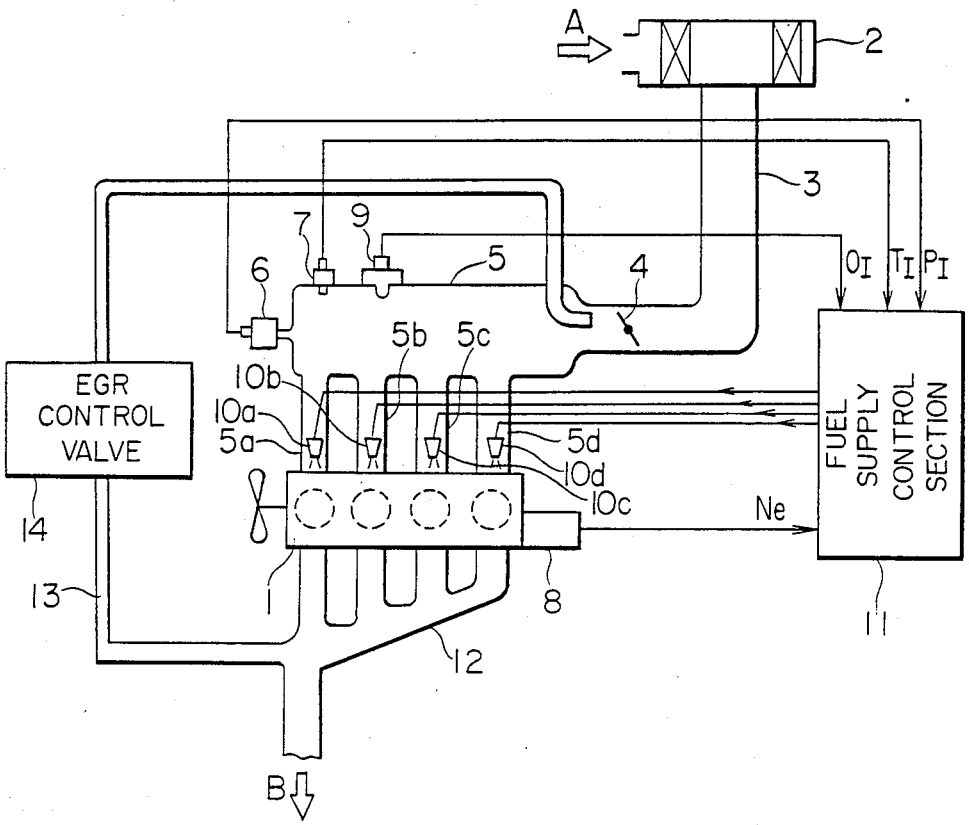
FIG. 1 is a diagrammatic view showing the general arrangement of a fuel supply control system for an internal combustion engine in accordance with the present invention.

Referring to FIG. 1, there is shown a four-cycle spark-ignition type internal combustion engine which includes an engine proper 1 having four cylinders, an air cleaner 2, an intake pipe 3 connected at its one end to the air cleaner 2 and at its other end to the engine proper 1 via a surge tank 5 and an intake manifold having four branch intake passages 5*a* through 5*d* connected with the respective engine cylinders, a throttle valve 4 disposed in the intake pipe 3, and four fuel injection valves 10*a* through 10*d* of electromagnetic type disposed in the branch passages 5*a* through 5*d*, respectively, for injecting fuel therein. With the above arrangement, air is sucked, as indicated by arrow A, from the air clearer 2 into the respective cylinders of the engine proper 1 by way of the intake pipe 3, the throttle valve 4, the surge tank 5 and the respective branch intake passages 5*a* through 5*d* of the intake manifold. On the other hand, fuel is discharged into the respective branch intake passages 5*a* through 5*d* from the respective fuel injection valves 10*a* through 10*d* and fed into the respective engine cylinders together with the intake air sucked from the air cleaner 2 for combustion therein.

Mounted on the surge tank 5 are a pressure sensor 6 for detecting the pressure $P_I$ of intake gases including intake air and recirculated exhaust gas (which is described later in detail) in the surge tank 5 or in the portion of the intake pipe 3 downstream of the throttle valve 4, and a temperature sensor 7 for detecting the temperature of the intake gases in the surge tank 5 or in the portion of the intake pipe 3 downstream of the throttle valve 4.

An ignition control section 8 is provided on the engine proper 1 for controlling ignition of the respective engine cylinders as well as generating an ignition signal.

An oxygen density sensor 9 is provided on the surge tank 5 for measuring the oxygen density in the intake gases in the surge tank 5, and comprises, for example, an oxygen density measuring device of a solid electrolyte oxygen pump type as disclosed in Japanese Patent Laid-Open No. 56-130649 laid open in 1981. The oxygen density sensor 9 has a built-in heater (not shown) for heating it to normal operating temperatures (for example, temperatures above 600° C.) at which the sensor is able to perform its intended function.

The respective output signals generated by the pressure sensor 6, the temperature sensor 7, the ignition control section 8 and the oxygen density sensor 9 are input to a fuel supply control section 11 which processes the information thus input and controls the operations of the respective fuel injection valves 10*a* through 10*d*.

An exhaust manifold 12 is connected with the respective engine cylinders for ultimate discharge of the exhaust gas from the respective engine cylinders to the atomsphere, as indicated by arrow B. An exhaust gas recirculation passage 13 (hereinafter referred to as EGR pasage) is connected at its one end with the exhaust manifold 12 and inserted at its other end into the intake pipe 3 at a location downstream of the throttle valve 4 for recirculating a part of the exhaust gas from the exhaust manifold 12 to the intake pipe 3. Inserted in the EGR passage 13 is an EGR control valve 14 which is adapted to be regulated by the intake vacuum in the intake passage 3 downstream of the throttle valve 4 or by electromagnetic force so as to control the amount of EGR in accordance with the engine operating conditions.

Figure 2:
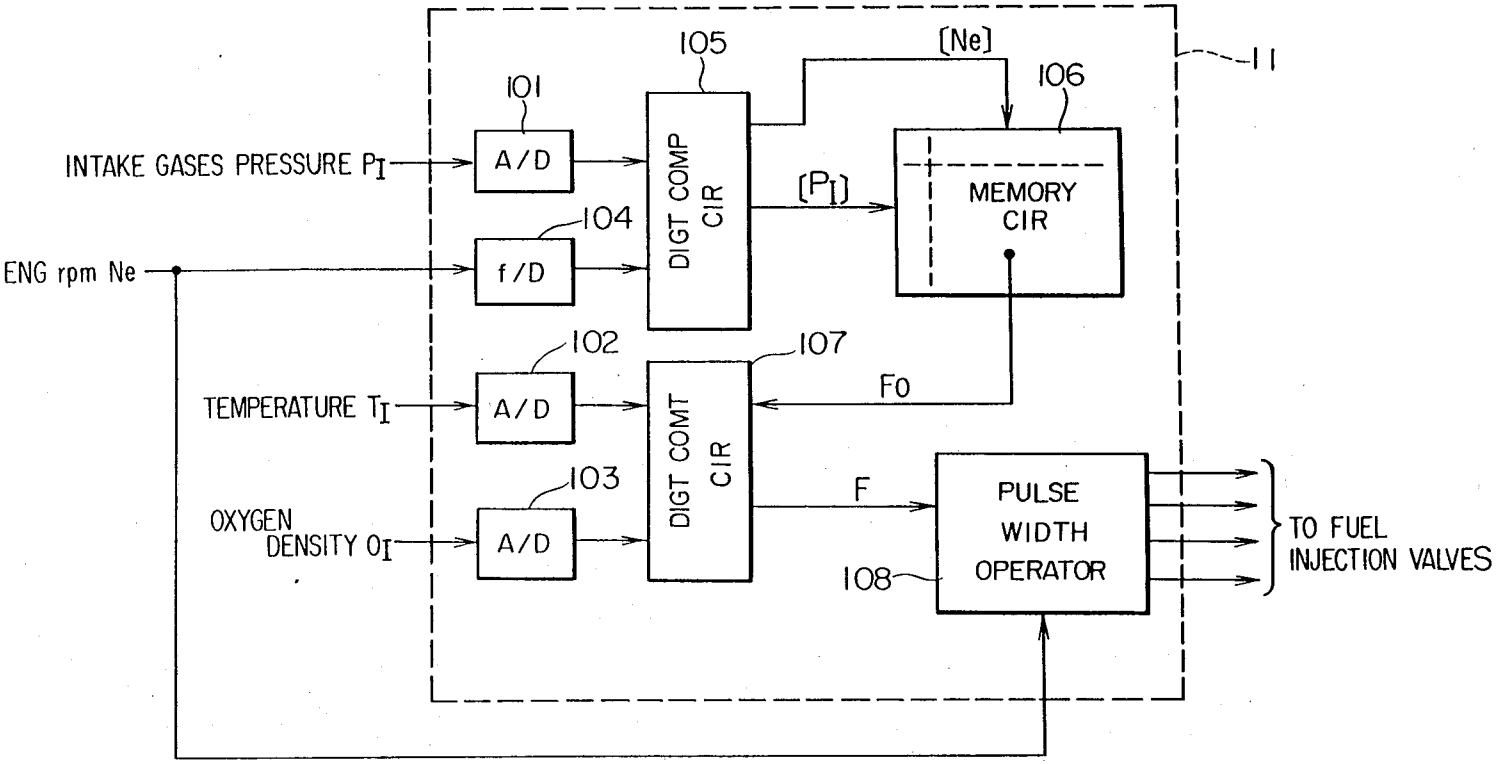
FIG. 2 is a block diagram showing a fuel supply control section of the fuel supply control system of FIG. 1.

Now, the operation of the above-described fuel supply control system of the present invention will be described by referring to the detailed construction of the fuel supply control section 11 as illustrated in FIG. 2.

The output signal $P_I$ of the pressure sensor 6, the output signal $T_I$ of the temperature sensor 7, and the output signal $O_I$ of the oxygen density sensor 9, all being in the form of analog signals, are fed to A/D converters 101 through 103, respectively, and converted there into digital signals. The ignition control section 8 sends out an output signal Ne having a frequency proportional to the engine RPM to the f/D converter 104 wherein to output signal Ne is converted into a digital signal. The output digital signals from the A/D converter 101 and the f/D converter 104 are input to a digital operation circuit 105 which serves to filter such digital information in a digital manner to generate signals [Ne] and [$P_I$] which are adapted to be read out by a memory circuit 106.

The digital circuit 106 is, for example, one storing a two-dimensional map as disclosed in Japanese Patent Laid-Open No. 59-20542 laid open in 1984. More specifically, the digital circuit 106 has various basic data Fo in the form of a table map stored in a ROM, the basic data Fo determining the amount of fuel corresponding to varying engine operating conditions which are classified in a two-dimensional manner according to the engine RPM [Ne] and the pressure [$P_I$] of intake gases, in other words, the basic data Fo determining the operation time of the fuel injection valves 10*a* through 10*d* which act to intermittently inject fuel into the respective intake manifold branch passages 5*a* through 5*d* in synchronization with engine revolutions. The data Fo stored in the memory circuit 106 is read out by means of read-out signals [$P_I$] and [Ne] fed to the memory circuit 106 from the digital operation circuit 105, and is then input to a digital computing circuit 107.

In the digital computing circuit 107, the data Fo thus read out from the memory circuit 106 is subjected to a correcting operation process by the use of the intake gases temperature and the oxygen density in the intake gases, that is by the digital information corresponding to the output signal $T_I$ of the temperature sensor 7 and the output signal $O_I$ of the oxygen density sensor 9. In other words, the above data Fo is corrected on the basis of a change in the density of the intake gases in accordance with the temperature of the intake air, and at the same time, the density or partial pressure of the oxygen in the intake gases varied by mixing of the EGR gas with the intake air. For example, when the EGR mixing ratio (the ratio of the flow rate of the EGR gas to the flow rate of the intake air) is 30% and if fuel is supplied from the fuel injection valves 10*a* through 10*d* to the respective engine cylinders at a stoichiometric air/fuel ratio of about 14 with the resultant oxygen density in the EGR gas being 0%, the density or partial pressure of the oxygen in the intake gases becomes about 16.1% in contrast to the fact that oxygen density in the atmosphere is about 21%. Accordingly, the condition of fuel supply, determined by the data Fo in the absence of EGR, is corrected such that if the oxygen density in the intake air corresponding to the output signal $O_I$ of the oxygen density sensor 9 is $D_i$%, a correction of $F = Fo \times D_i/21$ is effected for the data Fo.

The data F corrected in the above manner is fed to a pulse width operator 108. In this connection, in the aforementioned Japanese Patent Laid-Open No. 59-20542, the known pulse width operator 108 operates to calculate the operation time (the opening time) of the fuel injection valves 10*a* through 10*d* suited to the amount of fuel supply on the basis of the data F, and send out to the fuel injection valves 10*a* through 10*d* an operation time signal in synchronization with the signal [Ne] which is proportional to the engine RPM output from the ignition control section 8, so that the respective fuel injection valves 10*a* through 10*d* are operated by the operation time signal, thereby enabling fuel to be supplied from the fuel injection valves to the respective engine cylinders in such a manner as to provide an optimal air/fuel ratio at all times even in cases where EGR control is effected by the EGR control valve 14 in accordance with the engine operating conditions.

What is claimed is:

1. In an internal combustion engine which is adapted to be supplied with fuel by fuel injection means and in which is part of exhaust gas discharged from the engine proper is adjustable recirculated to a location downstream of a throttle valve in an intake pipe, a fuel supply control system comprising:

an engine revolutions per minute (RPM) detecting means for detecting the number of revolutions per minute of said engine;

a pressure detecting means for detecting manifold pressure of the intake gases in the portion of said intake pipe downstream of said throttle valve;

an oxygen density detecting means for detecting the density of the oxygen in the intake gases in said intake pipe after a part of the engine exhaust gas has been recirculated to said intake pipe downstream of said throttle valve;

a memory means for prestoring data determining the amount of fuel to be supplied to said engine in the absence of the exhaust gas recirculation and corresponding to respective engine operating conditions which are determined by the manifold pressure of the intake gases downstream of said throttle valve detected by said pressure detecting means and the engine RPM detected by said engine RPM detecting means, the data being classified in a two dimensional manner;

a correcting means for correcting the data, which is read out from said memory means corresponding to the engine RPM detected by said engine RPM detecting means and the manifold pressure of the intake gases detected by said pressure detecting means, by multiplying the data by a ratio of the oxygen density in the intake gases detected by said oxygen density detecting means to the oxygen density in the atmosphere; and a means for calculating a fuel injection time for said fuel injection means on the basis of the data corrected by said correcting means.

2. A fuel supply control system as set forth in claim 1 wherein said means for calculating a fuel injection time sends out to said fuel injection means a time pulse corresponding to the data corrected by said correcting means in synchronization with the engine RPM detected by said RPM detecting means.

3. A fuel supply control system as set forth in claim 1 wherein said oxygen density detecting means detects the oxygen density in the intake gases corresponding to the temperature of the intake gases.

* * * * *